US009615614B2

(12) United States Patent
Lamper

(10) Patent No.: US 9,615,614 B2
(45) Date of Patent: Apr. 11, 2017

(54) FASTENING POUCH OR POCKET FLAPS

(71) Applicant: Velcro BVBA, Deinze (BE)

(72) Inventor: Alan Lamper, Weare, NH (US)

(73) Assignee: Velcro BVBA, Deinze (BE)

( * ) Notice: Subject to any disclaimer, the term of this patent is extended or adjusted under 35 U.S.C. 154(b) by 662 days.

(21) Appl. No.: 14/053,789

(22) Filed: Oct. 15, 2013

(65) Prior Publication Data

US 2014/0102050 A1 Apr. 17, 2014

Related U.S. Application Data

(60) Provisional application No. 61/714,310, filed on Oct. 16, 2012.

(51) Int. Cl.
*A41D 27/20* (2006.01)
*A44B 18/00* (2006.01)

(52) U.S. Cl.
CPC ..... *A41D 27/201* (2013.01); *A44B 18/0061* (2013.01)

(58) Field of Classification Search
CPC .... A41D 27/201; A41D 27/20; A41D 27/205; A44B 18/0061
See application file for complete search history.

(56) References Cited

U.S. PATENT DOCUMENTS 3,848,594 A 11/1974 Buell
4,047,650 A 9/1977 Domingos
4,669,127 A * 6/1987 Swanson ..... A41D 13/0012 2/102
4,869,724 A 9/1989 Scripps
4,884,323 A 12/1989 Provost et al.
4,963,140 A 10/1990 Robertson et al.
5,032,122 A 7/1991 Noel et al.
5,133,112 A 7/1992 Gomez-Acevedo
5,361,462 A 11/1994 Murasaki
6,763,556 B2 7/2004 Fagan et al.
6,810,529 B1 * 11/2004 Reilly ..... A41D 27/20 2/247
7,172,008 B2 2/2007 Vanbenschoten et al.
7,270,255 B2 * 9/2007 Badillo ..... A45C 9/00 224/191

(Continued)

FOREIGN PATENT DOCUMENTS

EP 482873 A1 4/1992
WO WO2005020737 A1 3/2005

*Primary Examiner* — Shaun R Hurley
*Assistant Examiner* — Andrew W Sutton
(74) *Attorney, Agent, or Firm* — Fish & Richardson P.C.

(57) ABSTRACT

A pouch having a flap and a closure system featuring a face fastener attached to the front wall of the pouch body, and a mating flap fastener as part of the flap. One fastener of the closure system is a loop fastener component carrying a field of hook-engageable fibers. The other fastener of the closure system is a hook fastener component with an array of hooks. A significant majority of the hooks are oriented such that their heads point in a common lateral direction. The flap is elastically stretchable by pulling on its free edge, such that the flap maintains the loop fastener component securely engaged to the hook fastener component when under tension, and such that stretching the flap reduces engagement between the loop fastener component and the hook fastener component.

19 Claims, 10 Drawing Sheets

(56) References Cited

U.S. PATENT DOCUMENTS

| | | | | |
|---|---|---|---|---|
| 7,404,241 | B2 | 7/2008 | Murayama et al. | |
| 7,475,455 | B2 | 1/2009 | Ishibashi et al. | |
| 2002/0023321 | A1* | 2/2002 | Clune | A44B 18/0049 24/306 |
| 2006/0137148 | A1 | 6/2006 | Murayama et al. | |
| 2007/0026181 | A1 | 2/2007 | Roberts | |
| 2007/0221693 | A1* | 9/2007 | Moore | A45F 3/16 224/148.6 |
| 2008/0222780 | A1* | 9/2008 | Johnson | A41D 27/205 2/251 |
| 2009/0013506 | A1 | 1/2009 | Mizuhara et al. | |
| 2010/0064486 | A1 | 3/2010 | Hanlon | |
| 2011/0166635 | A1* | 7/2011 | Nelson | A61F 7/02 607/112 |
| 2012/0185999 | A1* | 7/2012 | Raviv | A41D 27/205 2/247 |
| 2013/0276206 | A1* | 10/2013 | DuChene | A43B 1/0054 2/161.4 |
| 2014/0339240 | A1* | 11/2014 | Moore | B65D 81/3876 220/592.17 |

* cited by examiner

FASTENING POUCH OR POCKET FLAPS

TECHNICAL FIELD

The present invention relates to fastening pouch or pocket flaps with touch fasteners.

BACKGROUND

Traditionally, hook-and-loop fasteners comprise two mating components that releasably engage with one another, thus allowing coupling and decoupling of the two surfaces or objects. The male fastener portion typically includes a substrate having fastener elements, such as hooks, extending from the substrate. Such fastener elements are referred to as "loop-engageable" in that they are configured to releasably engage with fibers of the mating component to form the hook-and loop-fastening.

Among other things, hook-and-loop fasteners are employed to releasably engage a flap of a pouch or pocket, to hold the pouch or pocket closed. The hook-and-loop fasteners provide infinite adjustment capabilities adaptable to both empty and full pouches. Thus pouches with hook-and-loop fasteners are very well suited for garments where such qualities are important and appreciated.

Touch fastener materials are perceived by some to not be particularly suitable for applications in which quiet fastener operation is advantageous (such as in hunting or military garments, for example). Some efforts have been made to reduce the level and/or frequency of sound generated by the separation of touch fasteners, with limited success.

Further advances in the design of fastener products are sought, for this and for other applications.

SUMMARY

Various aspects of the invention feature a pouch or pocket fastening system with a hook fastener component having an array of fastening hooks oriented such that at least a significant majority of the hooks all point in a common direction to snag fibers, and a resiliency of the pouch or pocket flap that is stretched to engage the hooks and retains some shear load on the engaged hooks to keep the hooks engaged until the flap is again stretched to release the hooks.

According to one aspect of the invention, the pouch includes a pouch body defining an opening and an interior volume between a front wall and a back wall of the pouch body, and a flap secured to the pouch body on one side of the opening and having a free edge. The flap is of sufficient length to extend across the opening of the pouch body and overhang the front wall of the pouch body. A closure system has a face fastener attached to the front wall of the pouch body, and a mating flap fastener as part of the flap. One of the face fastener and flap fastener includes a loop fastener component carrying a field of hook-engageable fibers and the other of the face fastener and flap fastener including a hook fastener component with an array of hooks, each hook including a stem and a head extending laterally from a distal end of the stem to form a fiber engagement overhang. A significant majority of the hooks are oriented such that their heads point in a common lateral direction. The flap is elastically stretchable by pulling on its free edge, such that the flap maintains the loop fastener component securely engaged to the hook fastener component when under tension, and such that stretching the flap reduces engagement between the loop fastener component and the hook fastener component.

In some implementations, the significant majority of the hooks includes at least 80 percent of the hooks. The significant majority of the hooks can include essentially all of the hooks.

In some cases, the elastically stretchable region of the flap is hook-engageable. The flap can include an elastic material to which the loop fastener component is attached. The flap can include an elastically stretchable region and an inelastic region, and wherein the flap fastener is secured to the inelastic region and spaced from the elastically stretchable region. The flap fastener may be disposed between the elastically stretchable region and the free edge, for example.

In some examples, the hooks are arrayed in rows and columns, each row and column including multiple hooks.

The pouch may be a pocket of a garment, for instance. The back wall of the pouch body can be of a material forming an outer surface of the garment.

In some applications, the hook heads extend to distal tips that are reentrant, such that the overhang includes a bounded crook.

In some implementations, the flap can be relatively inelastic across a region overlapping the flap fastener. The flap can be relatively inelastic in a direction parallel to its free edge, for example. In some cases, the flap is significantly stiffer across the flap fastener than in a region between the flap fastener and an edge of the flap at which the flap is secured to the pouch body.

In some examples, the front sides of the hooks form engagement overhangs, while the rear sides of the hooks are free of overhangs.

Another aspect of the invention features a method of securing and releasing a pouch flap. The method includes positioning an elastically stretchable flap to extend over an opening of a pouch, such that a first touch fastener component on an inner face of the flap releasably engages with a second touch fastener component attached to an outer surface of the pouch across an engagement plane. One of the first and second touch fastener components includes a loop fastener component carrying a field of engageable fibers, and the other of the first and second touch fastener components includes a hook fastener component with an array of hooks, each hook including a stem and a head extending laterally from a distal end of the stem to form a fiber engagement overhang. A significant majority of the hooks are oriented such that the raised portions are pointing in a single, common direction. Releasing the flap from the outer surface of the pouch can be accomplished by pulling on a free edge of the flap in a direction along the engagement plane, thereby stretching the flap to relatively displace the engaged first and second touch fastener components along the engagement plane and thereby reduce engagement between the loop fastener component and the hook fastener component, and then lifting the flap from the face of the pouch.

In some implementations, positioning the flap includes stretching the flap, such that residual tension in the stretched flap maintains a shear load across the fastening plane with the flap secured. The flap can be stretched with the first and second touch fastener components spaced apart, positioning the flap including bringing the stretched flap into contact with the outer surface of the pouch.

In some examples the method includes, with the flap positioned and prior to releasing the flap, stretching the flap in a direction along the fastening plane and then releasing the flap with the first and second touch fastener components in contact, thereby increasing a residual shear load in the fastening plane.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
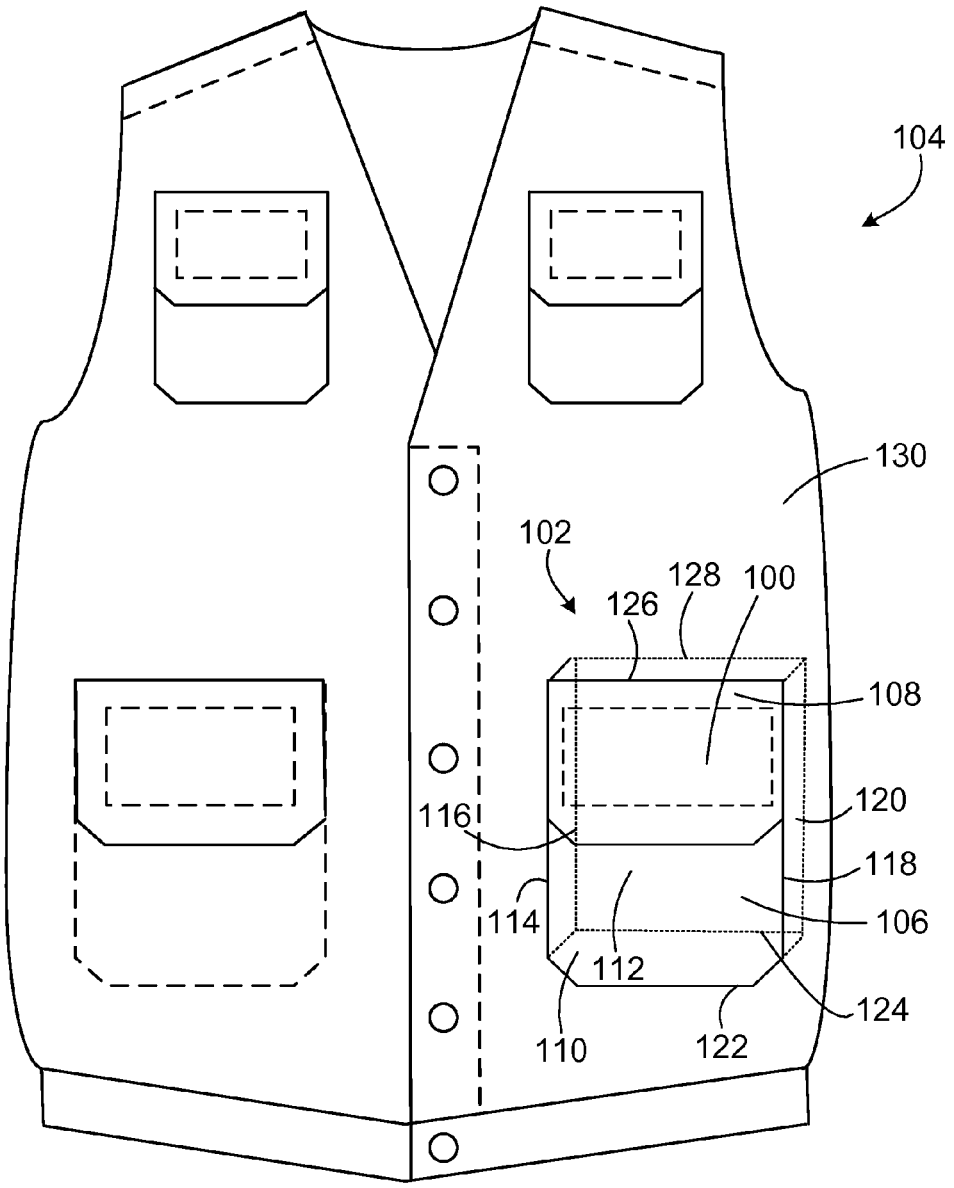
FIG. 1 is a perspective view of a garment featuring a pouch or pocket with a fastening system.

Referring to FIG. 1, a fastening system 100 is attached to a pouch 102 of a garment 104 (e.g., a hunting jacket). The pouch 102 includes a pouch body 106, a flap 108 and a fastening system 100. The pouch body 106 includes a front wall 110 and a back wall 112, each of which has respective lateral edges 114, 116, 118, 120, bottom edges 122, 124, and top edges 126, 128. In one embodiment, the face of the garment 104 itself forms the back wall 112 of the pocket or pouch. The interior volume of the pouch body 106 is sufficiently sized and adapted to store and carry items. In some cases, the pouch or pocket is gusseted, such that at the opening the front wall 110 is spaced from the back wall 112 across its width. In other examples, the side and bottom edges of the front wall 110 are sewn or otherwise secured directly against the face of the garment 104.

The flap 108 of the pouch 102 is attached to the back wall 112 of the pouch body 106. The flap 108 is of sufficient length to extend across the opening of the pouch body 106 and overhang the front wall 110 of the pouch body 106. The flap 108 can be lifted to provide access to the pouch body 106 interior volume. The inner side of the flap 108 and the exterior side of the front wall 110 of the pouch 102 carry the mating components of the fastening system 100.

In the example shown in FIG. 1, the pouch 102 is illustrated as being closed, the flap 108 overlapping the front wall 110 of the pouch 102. The components of the fastening system 100 connected to the flap 108 and the front wall 106 of the pouch 102 are engaged under shear tension in this position, such that the fastening system 100 holds the flap 108 attached to the front wall 110 of the pouch 102, as discussed in more detail below.

Figure 2B:
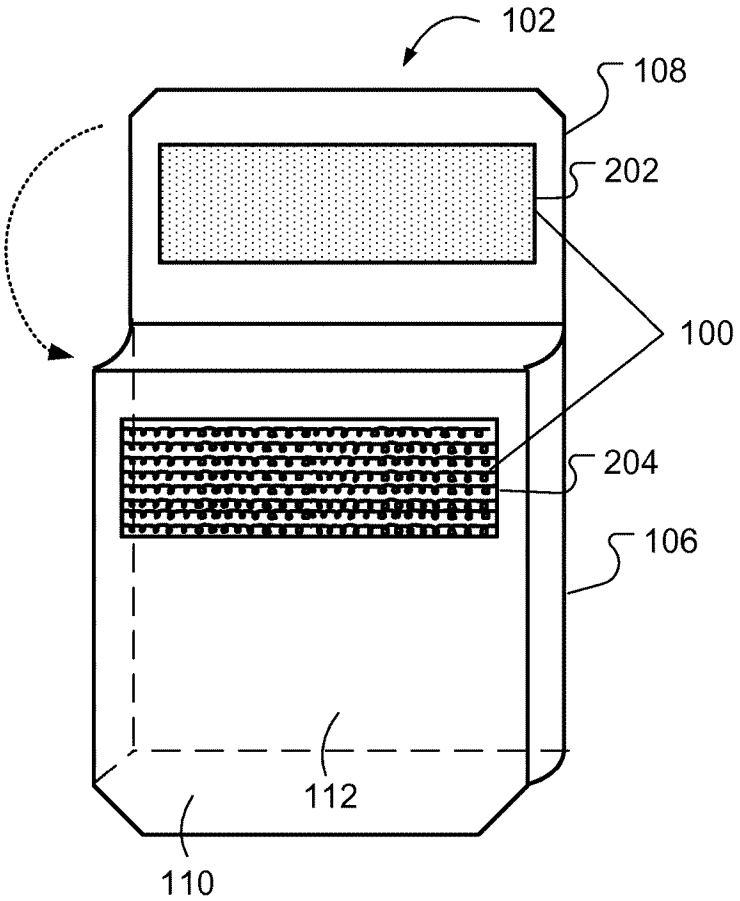
FIGS. 2A and 2B are front views of open pouches with different fastening system arrangements.
Figure 2A:
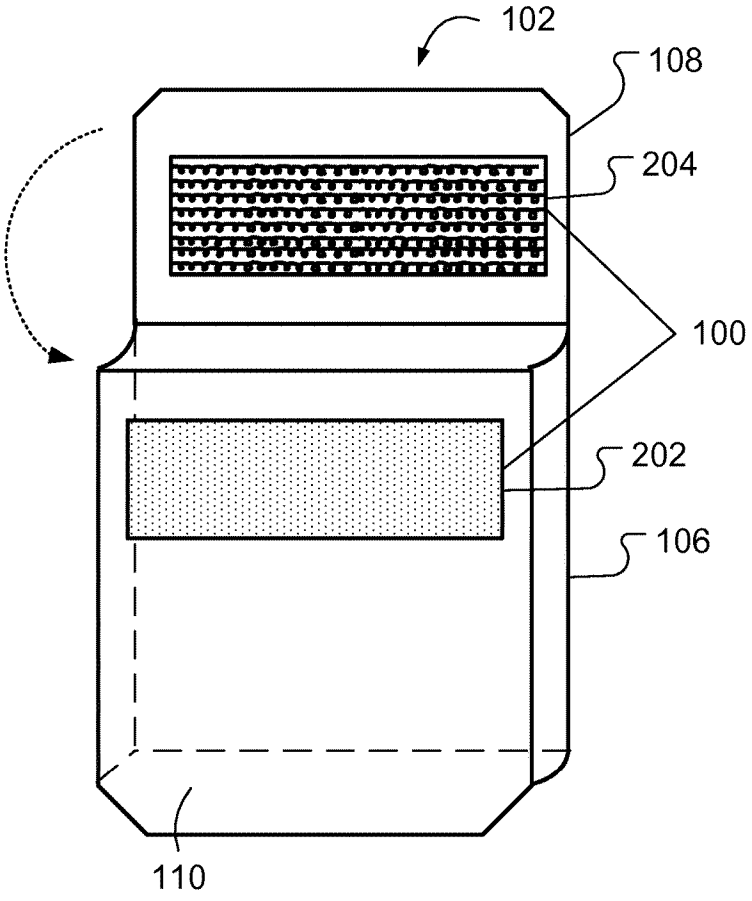

FIGS. 2A and 2B illustrate a front view of an open pouch 102, showing the fastening system 100 components, including a hook fastener component 202 and a loop fastener component 204 (e.g. a field of hook-engageable fibers). In the example of FIG. 2A, the hook fastener component 202 is secured to the front wall 110 of the pouch body 106 and the loop fastener component 204 is secured to the inner side of the flap 108. In FIG. 2B, the loop fastener component 204 is secured to the front wall 110 of the pouch body 106 and the hook fastener component 202 is secured to the inner side of the flap 108.

The hook fastener component 202 and the loop fastener component 204 can have equal or different sizes and shapes (e.g., rectangular, circular, oval) formed of a single or multiple pieces, such that the total area of the hook fastener component 202 and the total area of the loop fastener component 204 is enclosed by the surface of the front wall 110 of the pouch body 106 and by the surface of the flap 108, respectively.

The hook fastener component 202 includes an array of hooks, oriented such that the fiber-engaging heads of all or essentially all of the hooks or at least 80% of the hooks) are directed in a single, common, lateral direction corresponding with the direction of shear tension in the fastening. For example, in the arrangement shown in FIG. 2A, the heads of the hooks of hook fastener component 202 are all pointing downward, toward the lower edge of the pouch 102.

The reverse shear release function of the fastening system can best be illustrated in side view (FIGS. 3 A-D). In the pouch 102 of FIG. 3A, the flap 108 features an elastically stretchable region 302 of limited extent, disposed between the pouch body 106 and the loop fastener component 204. The loop fastener component 204 is disposed between the elastically stretchable region (302) and the free edge (303).

Figure 3A:
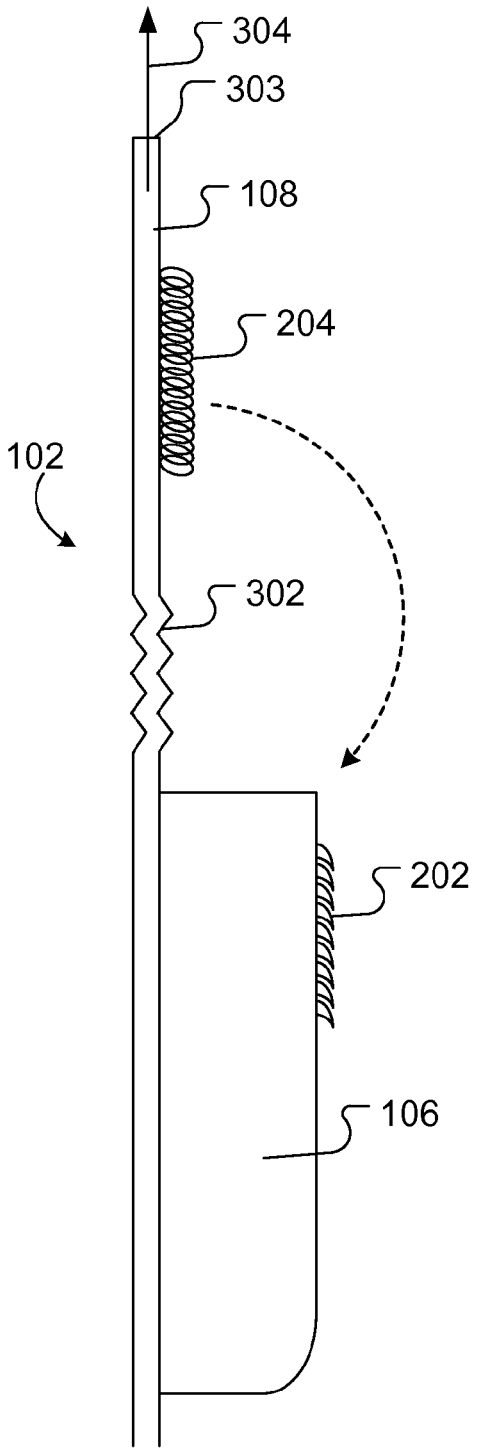
FIG. 3A is a side view of the open pouch of FIG. 2A, in which the pouch flap has a limited elastic region.
Figure 3B:
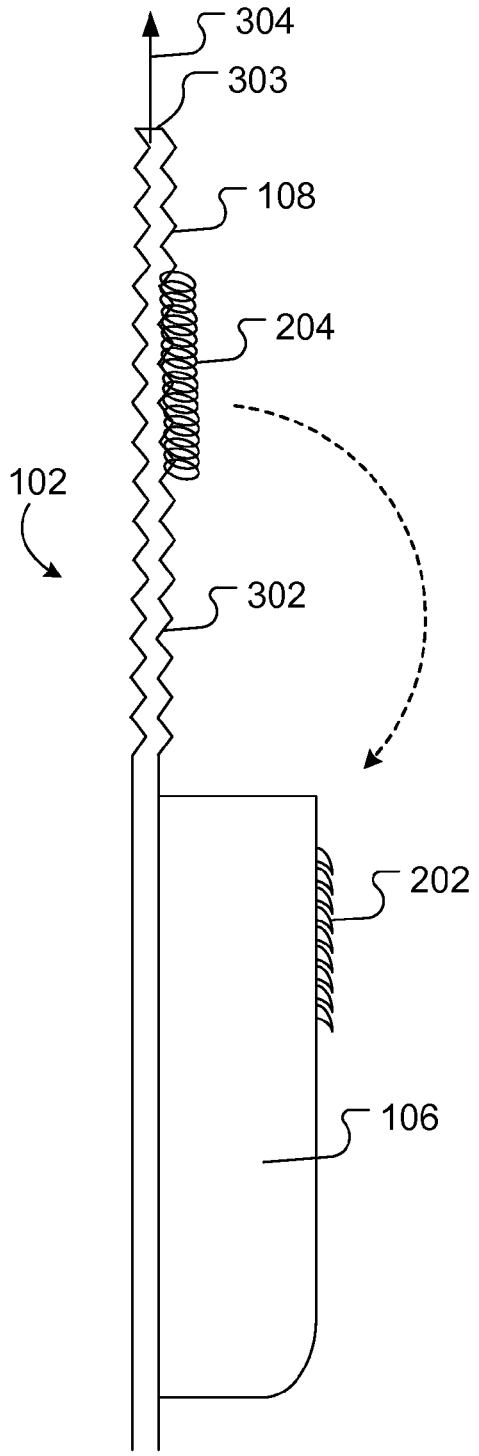
FIG. 3B is a side view of an open pouch having a flap that is elastic in the region underlying the engageable loops.

In the pouch 102 of FIG. 3B, the entire flap 108 is elastic in the stretching direction 304 (e.g. parallel to the interface between the loop fastener component 204 and the hook fastener component 202), including in the region directly overlapping loop fastener component 204. In some implementations, the flap 108 is relatively inelastic in a direction parallel to its free edge 303.

Figure 3C:
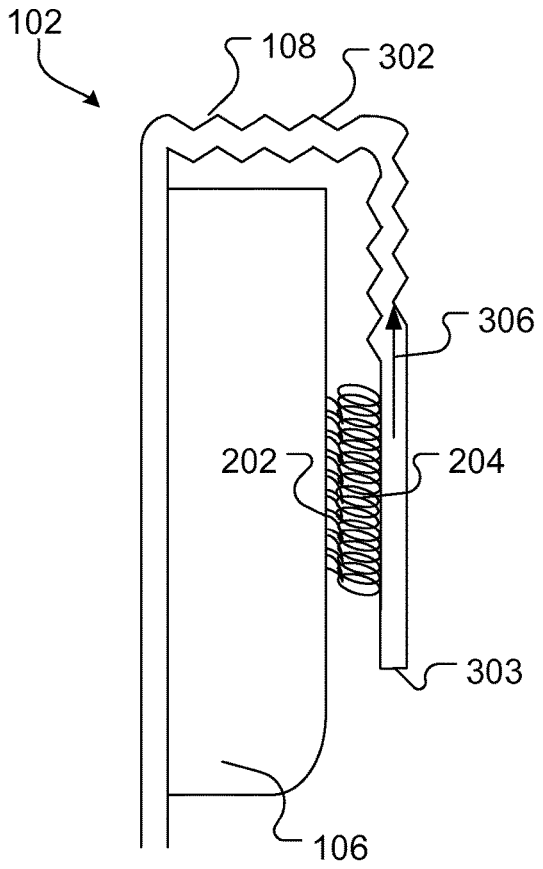
FIG. 3C shows the pouch of FIG. 3A in a closed state, with tension in the elastic region of the flap maintaining engagement of the closure system.

Referring next to FIG. 3C, the flap 108 is first secured over the front wall 110 of the pouch 102 by engaging the loop component 204 and hook fastener component 202 with the flap 108 preferably in at least a slightly stretched state. So engaged, a residual in-plane tension in flap 108 along the stretching direction maintains a residual shear load 306 across the fastening and a desired level of fastening performance.

Figure 3D:
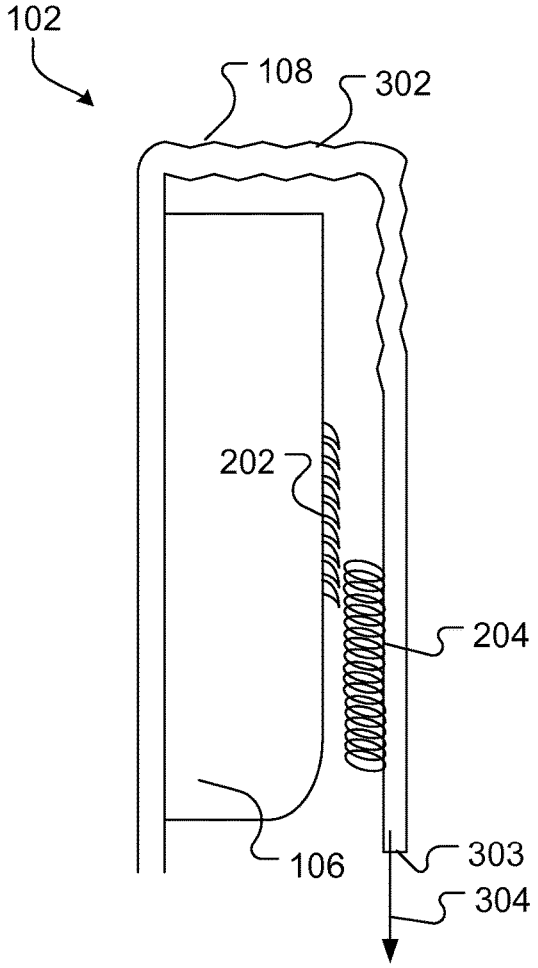
FIG. 3D illustrates opening the pouch of FIG. 3A by pulling downward on the free edge of the flap, in a reverse shear direction with respect to the fastening system, thereby releasing the fastening prior to lifting on the flap.

Referring to FIG. 3D, disengagement of the components of the fastening system 100 involves first applying a similar tension to the flap 108 along the stretching direction 304, such as by pulling downward on the distal or free edge 303 of the flap 108. The applied stress causes a resilient elongation 302 of the flap 108, relatively displacing the hook and loop fastener components in a reverse shear direction, significantly reducing (or in some cases, eliminating) engagement between the fastening components prior to peeling the flap 108 away from the face of the pouch 102. In this manner, disengagement noise is significantly reduced.

In some cases, the fastener component attached to the flap 108 is elastically stretchable in its plane in the direction in which the shear tension is applied during engagement, and relatively inelastic in a perpendicular in-plane direction. For relatively larger fastening areas (e.g., fasteners having a width of more than about 20 mm), it can be advantageous to fashion the fastener component of the flap 108, or the portion of the flap material underlying the fastener component, to be relatively inflexible to bending. Not only can this help resist buckling of the flap 108 during stretch, but it can also make it much easier to achieve a more uniform stretch displacement along the entire fastening width, to help ensure that most if not all hooks are disengaged before the flap 108 is moved away from the face of the pouch 102. The uniform elongation of the flap 108 combined with the planar displacement of the fastener components helps to ensure simultaneous disengagement of the hook fastener component 202 from the loop fastener component 204 with reduced noise.

Figure 4A:
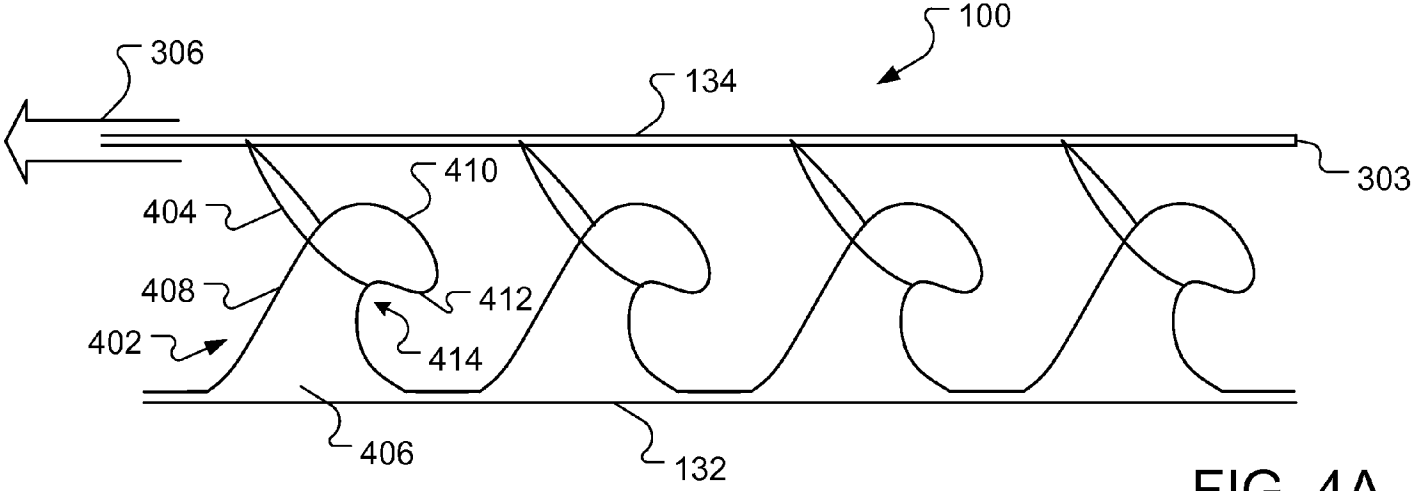
FIGS. 4A and 4B are enlarged perspective views of fastener products in engaged and disengaged configurations, respectively.
Figure 4B:
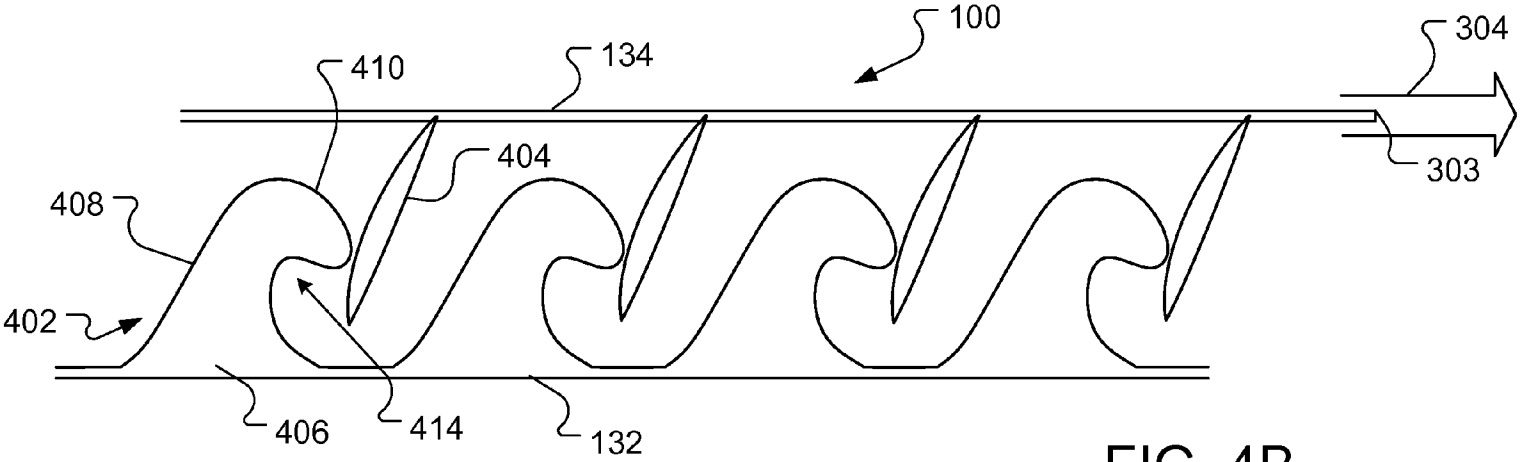

FIGS. 4A and 4B schematically illustrate the effect of shear load 306 (such as due to in-plane elastic stretch) on engagement states for a unidirectional fastening array. FIG. 4A shows the engagement of the hook fastener component 202 with the loop fastener component 204, under a shear load 306 that maintains a slight tension in the engaged fibers, and the loops pulling on the hooks in a direction away from their tips 412. The shear load 306 keeps each loop 404 of the loop fastener component 204 in the crook 414 of the corresponding hook 402. In FIG. 4B, the direction of the shear load 306 is in the opposite direction, moving the loops out of engagement.

Figure 5:
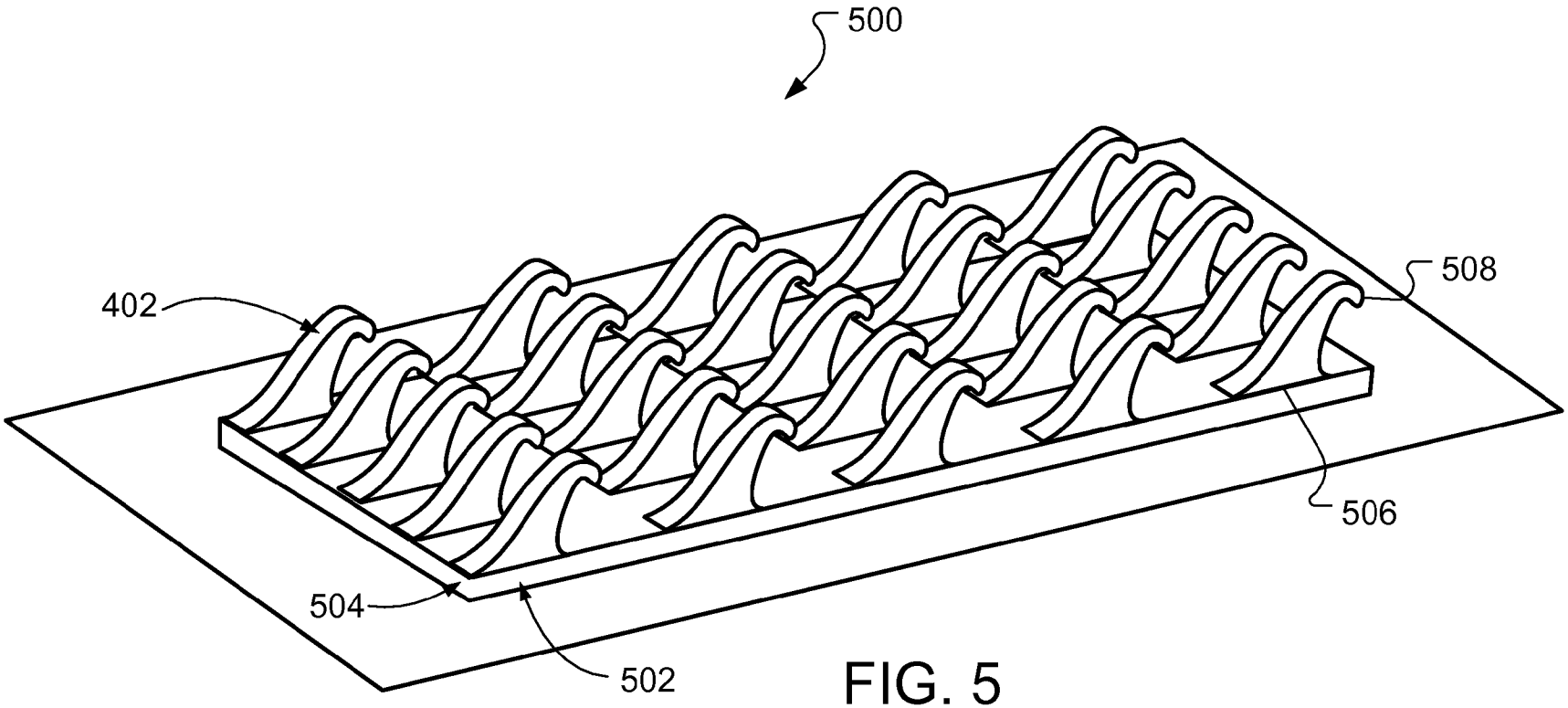
FIG. 5 is a perspective view of a unidirectional array of hooks.

Referring to FIG. 5, an exposed face of a hook fastener component 202 of a releasable fastening system 100 includes an array 500 of hooks 402 arranged in rows 502 and columns 504 extending outwardly from a sheet-form base 506, and together forming with the base a contiguous mass of resin.

All hooks 402 are oriented to overhang the base 506 in a single, common direction, each hook 402 extending from the base 506 to a distal tip 508 on a front or forward side of the hook 402. The back or rear sides of the hooks 402 are oriented away from the base 506, such that no overhang is formed on the rear sides of the hooks.

U.S. Patent Application Ser. No. 61/328,257 filed Apr. 27, 2010 and entitled "Male Touch Fastener Element," which is hereby incorporated in full by reference, describes hooks 402 suitable for use in releasable engagement systems.

Figure 6A:
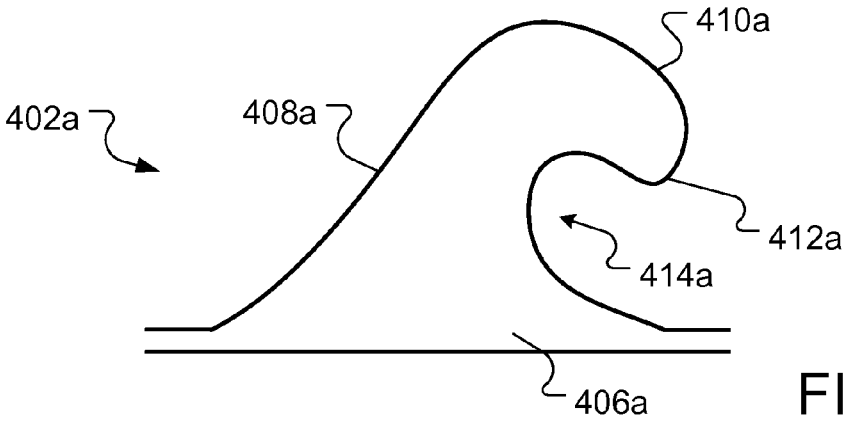
FIGS. 6A-6C illustrate different examples of hooks.
Figure 6B:
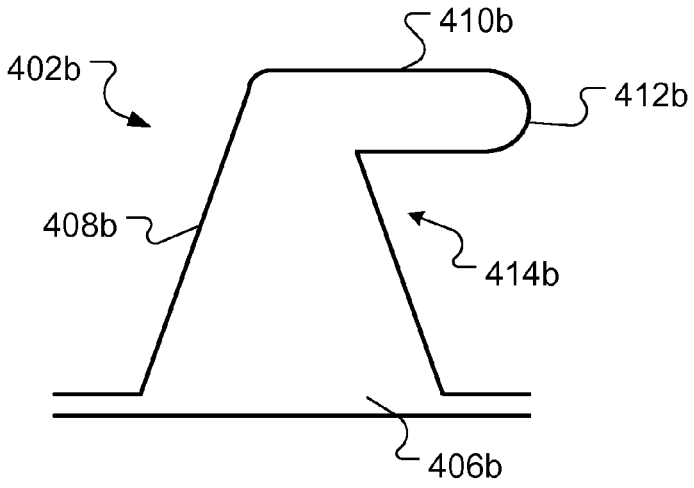
Figure 6C:
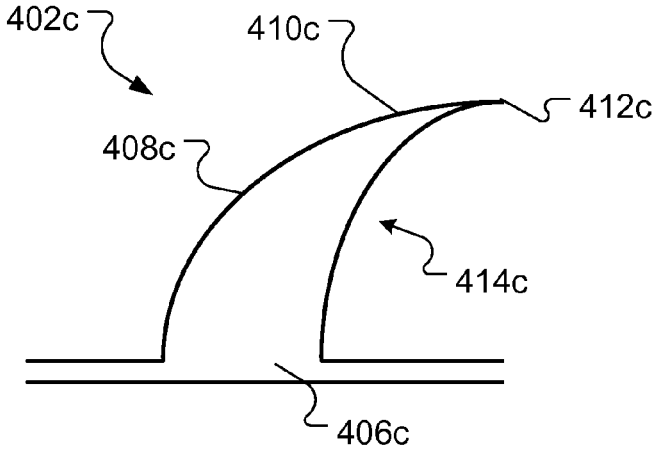

FIGS. 6A-6C show various types of hook shapes that can be incorporated into the hook fastener component 202. Each of these examples features a stem or stalk molded with a sheet-form base, such that the stems and base form a single, contiguous resin mass. In some cases the heads of the hooks 402 are also molded; in other examples the heads are formed after the stems are molded.

In the example of FIG. 6A, the head of the hook 402*a* overhangs the outer stalk surface (i.e., extends laterally beyond the stem) to define a fiber retention overhang or crook 414*a* for retaining fibers of a mating component to form a hook-and-loop fastening. The hook 402*a* has a substantially constant thickness from base to tip, and includes a stem 408*a* rising from a base 406*a*, and a head 410*a* overhanging the base 406*a* from a front side of stem to a distal tip 412*a*. Head 410*a* only forms such an overhang in one direction, referred to as the front of the hook, while the back of the hook 402*a* is a smooth sloping surface free of any overhang. In the hook of FIG. 6A, tip 412*a* is reentrant, in that it extends somewhat back toward the plane of the base from which the hook extends. The resulting crook 414*a* is bounded, having a highest elevation higher than the lowest extent of tip 412*a*. Hooks 402*a* with a significantly re-entrant tip and deep retention cavity may most readily disengage in reverse shear when paired with stiffer, higher loft loop fibers. Other details of this fastener element design can be found in U.S. Patent Application Ser. No. 61/328,257.

FIG. 6B shows an example of a hook 402*b* with a trapezoidal stem 408*b* rising from a base 406*b*, and a head 410*b* extending laterally to one side and having a flattened top surface parallel to base 406*b*, and a rounded tip 412*b*. Head 410*b* overhangs the front side of stem 408*b* to form a loop retention space. Such a hook shape may be fashioned by molding a straight stem with sloped sides, and then deforming the distal end of the stem by a method that drives the resin of the stem end in a single lateral direction, such as by melting the stem end and pushing the melted resin to one side by a flow of air or a mechanical device, or by flattening the stem end with a roller that is driven to push the resin to one direction during flattening. More detail of such a method is provided below with respect to FIG. 8.

FIG. 6C illustrates a hook 402*c* that has a decreasing thickness from base 406 to a relatively sharp tip 412*c*, and is inclined to the side such that tip 412*c* overhangs base 406*c*. The inclination angle, length and thickness of the stem 408*c* and other characteristics of the hook 402*c* vary between implementations to achieve varying degrees of performance with respect to peel resistance and/or to mitigate loop breakage. Other details of this fastener element design can be found in U.S. Patent Publication No. 2003/0106188 A1. Such a fastener structure can be useful to snag relatively low-loft fibers, such as fibers of a fabric not necessarily engineered to function as a loop fastener. The lack of a re-entrant tip in the examples of FIGS. 6B and 6C helps to ensure disengagement of such fibers during reverse shear loading.

Figure 7A:
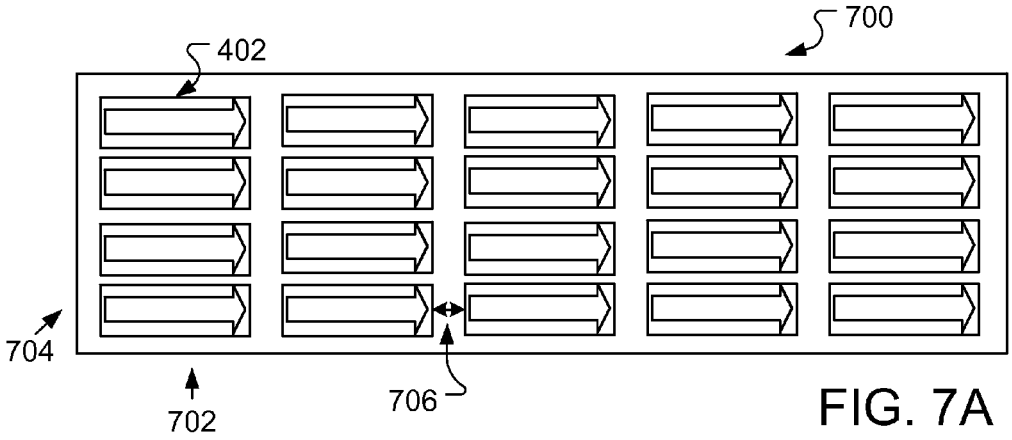
FIGS. 7A-7C are schematic top views of hook arrays having different hook patterns.
Figure 7B:
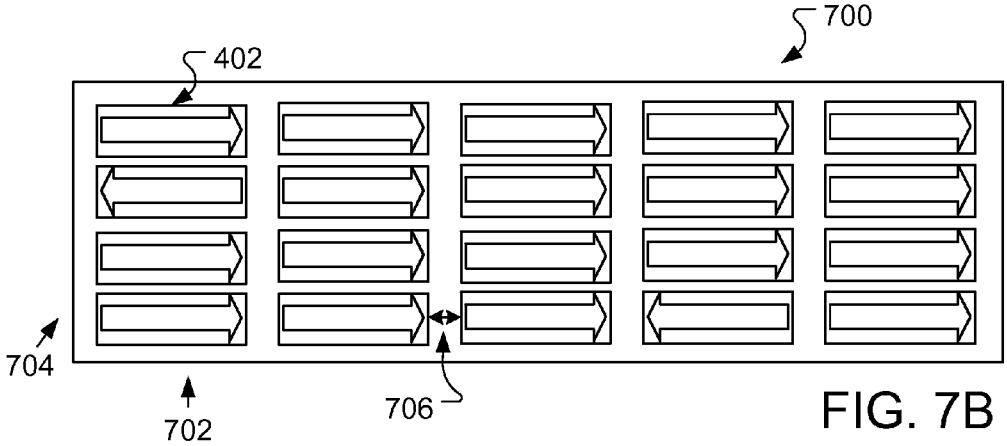
Figure 7C:
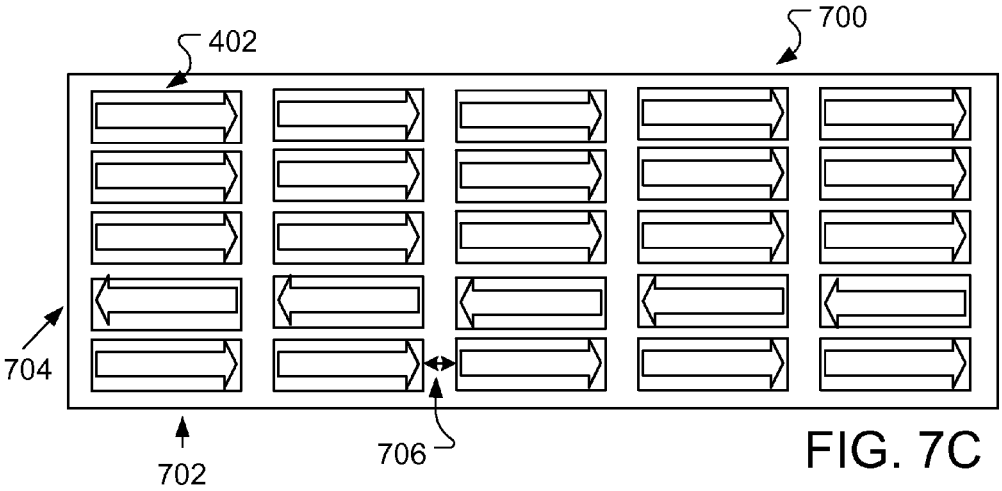

FIGS. 7A, 7B and 7C illustrate different arrangements of hooks on a hook fastener component 202. In each illustrated example, the hooks 402 are arranged in equidistant rows 702 and columns 704. The distance 706 between the rows 702 can be chosen to maximize the distance in front of each exposed hook tip, to give space for loop penetration and engagement. In general, the pitch spacing of adjacent hooks along a column 704 should be selected in combination with the vertical distance from the top of the hooks to their tips and the resilience of the loops with which the hook fastener component is to be mated, to ensure that as the hook fastener component slides along the loop material in the engagement direction the loop fibers can drop sufficiently far behind one hook of the column to be snagged by the following hook.

In the arrangement of FIG. 7A all hooks 402 within the hook fastener component 202 are aligned (as indicated by the direction of the arrow) with what would be considered the machine direction (or reverse machine direction) of the product, forming a unidirectional arrangement of all hook elements in which the front or primary overhang sides of the hooks all face in the same direction. This unidirectional alignment of the hook elements can help to maximize reverse-shear disengagement of the array with a mating loop fastener component, thus maximizing the corresponding noise reduction effect.

In the arrangement of FIG. 7B, the vast majority of hooks 402 within the hook fastener component 202 remain aligned (as indicated by the direction of the arrow) with what would be considered the machine direction of the product, forming a predominant unidirectional arrangement of the hook elements. However, in this arrangement there are some hooks (as indicated by the arrows pointing to the left) that have their front or primary overhand sides directed in the opposite sense. The fastening performance of these opposite-directed hooks controls the resistance to peel when the flap 108 of the pouch 102 is stretched for disengagement, and the number and arrangement of these hooks can be selected for a desired feel and associated disengagement sound. The presence of such hooks can also help to avoid inadvertent pouch 102 opening under light tension loads.

In the arrangement of FIG. 7C, the hooks of one column 704 out of every five columns are oriented to face in a direction opposite that of the hooks of the other columns, as indicated by the arrows, such that 80% of the hooks face in a common direction. In hook molding processes in which each column 704 of molded hooks corresponds to a single molding plates or rings, reversal of one out of every 5 or more of such plates or rings can be readily accomplished. The array of hooks on the hook fastener component can be configured, for example, such that each side of the array has such a reversed hook column at or near the array edge, to help to maintain engagement at the edge of the array.

Small, controllable amounts of reverse shear load resistance can also be obtained by providing small overhangs (not shown) on the lateral sides of the hooks (i.e., the sides bounding the front face of the hook). Such overhangs may help to provide small corners that stag loop fibers but readily release them under reverse shear loading. Such small cross-machine direction overhangs can be formed, for example, by slightly flattening the upper ends of molded hooks. Preferably, such flattening is controlled to form little, if any, overhang at the back face of the hook.

Figure 8A:
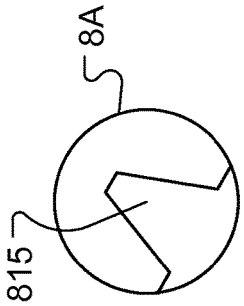
FIGS. 8A and 8B are enlarged views of areas 8A and 8B, respectively, of FIG. 8.
Figure 8B:
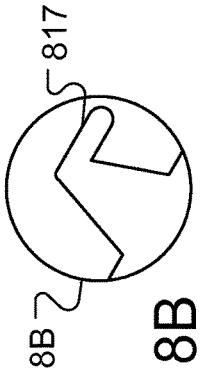
Figure 8:
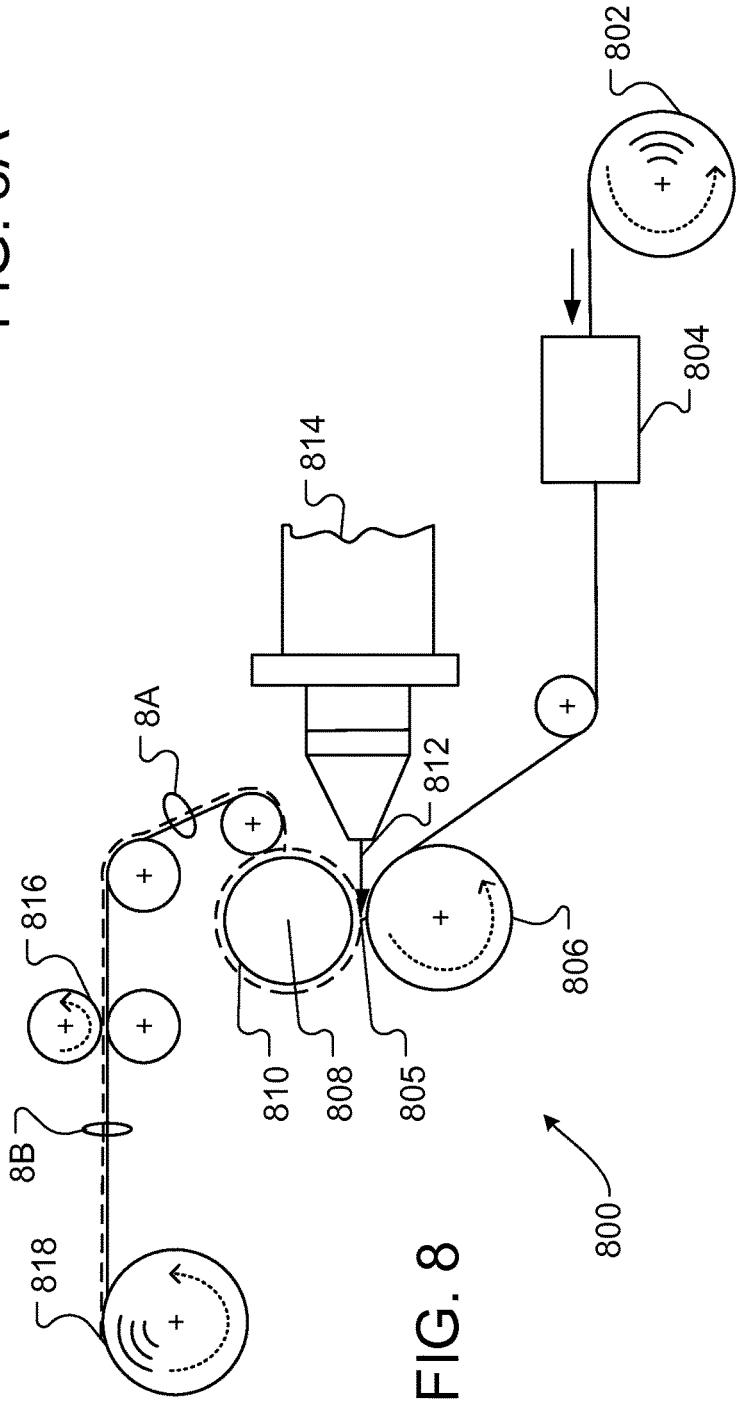
FIG. 8 schematically illustrates a machine and method for the manufacturing of molded hook stems directly on a material.

Referring to FIG. 8, an array of male fastener elements is formed directly on a substrate (such as a fabric, from which a pocket face or flap 108 is to be formed) by dispensing the preformed material from roll 802 and feeding it into a resin molding station 804. The material is fed through a nip 805 formed between a pressure roll 806 and a mold roll 808 (having a series of stem-forming cavities 810) together with molten resin 812 pumped from an extruder die 814. In this example, fastener element stems 815 (FIG. 8A) are molded in the cavities from the extruded resin while the resin is forced into pores of the material by nip pressure. After the stems have been pulled from their cavities, the nip-laminated material is fed to a heading station where the distal ends of the molded stems are deformed in a nip by pressure and heat applied by a roller 816 driven to have a surface speed different from that of the material, such that the resin of the stem ends is deflected laterally in a primary direction to create loop engageable heads 817 (FIG. 8B). The finished product is spooled up on a roll 818. After the continuous length of fastening material is formed, it moves through a die-cutting station (not shown).

In some examples the flap material itself is fed into the hook forming nip and a continuous lane (or a series of spaced regions) of fastener hook material is formed directly on the flap material. The preformed flap material (or a portion thereof) may be elastic in its widthwise direction, such that the continuous roll of flap material coming off of the apparatus of FIG. 8 is ready to be cut to discrete lengths to form flaps. Roll-molding of fastener tape directly onto substrates or backings such as non-woven webs is described, for example, in U.S. Pat. No. 7,048,818, the entirety of which is incorporated herein by reference.

Figure 9A:
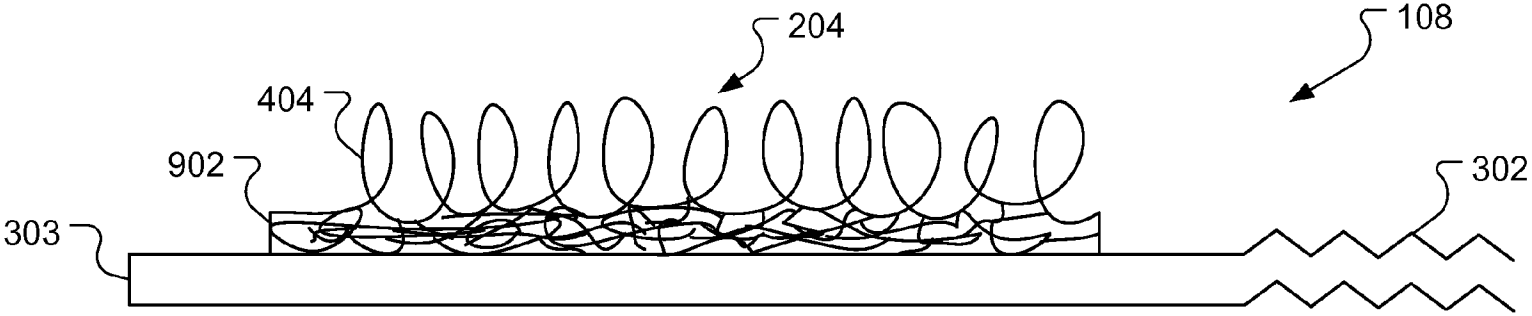
FIGS. 9A and 9B are side views of loop fastener components.
Figure 9B:
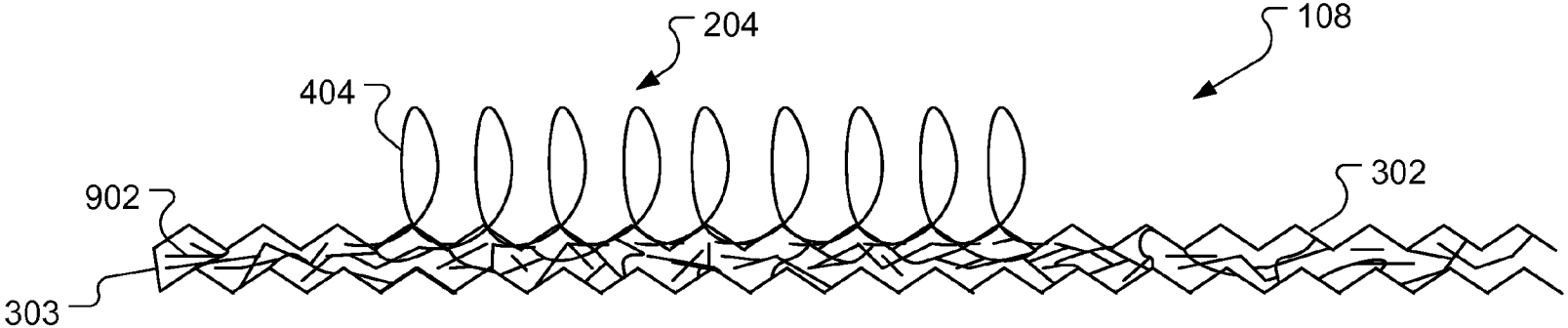

Referring to FIGS. 9A and 9B, loop fastener component 204 may include, for example, a knit, woven or nonwoven fabric 902 carrying an array of upstanding loops or engageable fibers and secured to an underlying material having an elastic region 302, as shown in FIG. 9A. Alternatively, the loop fabric itself may be elastic in at least a primary direction, as shown in FIG. 9B, with non-elastomeric fibers forming the loops 404.

A number of embodiments of the invention have been described. Nevertheless, it will be understood that various modifications may be made without departing from the spirit and scope of the invention. Accordingly, other embodiments are within the scope of the following claims.

What is claimed is:

1. A pouch comprising:

a pouch body defining an opening and an interior volume between a front wall and a back wall of the pouch body;

a flap secured to the pouch body on one side of the opening and having a free edge, the flap being of sufficient length to extend across the opening of the pouch body and overhang the front wall of the pouch body; and a closure system featuring a face fastener attached to the front wall of the pouch body, and a mating flap fastener as part of the flap, one of the face fastener and flap fastener comprising a loop fastener component carrying a field of hook-engageable fibers; and the other of the face fastener and flap fastener comprising a hook fastener component with an array of hooks, each hook comprising a stem and a head extending laterally from a distal end of the stem to form a fiber engagement overhang, wherein a majority of the hooks are oriented such that their heads point in a common lateral direction;

wherein the flap is elastically stretchable by pulling on its free edge, such that the flap maintains the loop fastener component securely engaged to the hook fastener component when under tension, and such that stretching the flap reduces engagement between the loop fastener component and the hook fastener component.

2. The pouch of claim 1, wherein the majority of the hooks comprises at least 80 percent of the hooks.

3. A The pouch of claim 2, wherein the majority of the hooks comprises essentially all of the hooks.

4. The pouch of claim 1, wherein an elastically stretchable region of the flap is hook-engageable.

5. The pouch of claim 1, wherein the flap comprises an elastic material to which the loop fastener component is attached.

6. The pouch of claim 1, wherein the flap comprises an elastically stretchable region and an inelastic region, and wherein the flap fastener is secured to the inelastic region and spaced from the elastically stretchable region.

7. The pouch of claim 6, wherein the flap fastener is disposed between the elastically stretchable region and the free edge.

8. The pouch of claim 1, wherein the hooks are arrayed in rows and columns, each row and column comprising multiple hooks.

9. The pouch of claim 1, wherein the pouch comprises a pocket of a garment.

10. The pouch of claim 9, wherein the back wall of the pouch body is of a material forming an outer surface of the garment.

11. The pouch of claim 1, wherein the hook heads extend to distal tips that are reentrant, such that the overhang comprises a bounded crook.

12. The pouch of claim 1, wherein the flap is relatively inelastic across a region overlapping the flap fastener.

13. The pouch of claim 1, wherein the flap is relatively inelastic in a direction parallel to its free edge.

14. The pouch of claim 1, wherein the flap is stiffer across the flap fastener than in a region between the flap fastener and an edge of the flap at which the flap is secured to the pouch body.

15. The pouch of claim 1, wherein front sides of the hooks form engagement overhangs and rear sides of the hooks are free of overhangs.

16. A method of securing and releasing a pouch flap, the method comprising:

positioning an elastically stretchable flap to extend over an opening of a pouch, such that a first touch fastener component on an inner face of the flap releasably engages with a second touch fastener component attached to an outer surface of the pouch across an engagement plane, one of the first and second touch fastener components comprising a loop fastener component carrying a field of engageable fibers, and the other of the first and second touch fastener components comprising a hook fastener component with an array of hooks, each hook comprising a stem and a head extending laterally from a distal end of the stem to form a fiber engagement overhang, wherein a majority of the hooks are oriented such that the raised portions are pointing in a single, common direction; and releasing the flap from the outer surface of the pouch by:

first pulling on a free edge of the flap in a direction along the engagement plane, thereby stretching the flap to relatively displace the engaged first and second touch fastener components along the engagement plane and thereby reduce engagement between the loop fastener component and the hook fastener component, and then lifting the flap from the face of the pouch.

17. The method of claim 16, wherein positioning the flap comprises stretching the flap, such that residual tension in the stretched flap maintains a shear load across the fastening plane with the flap secured.

18. The method of claim 17, wherein the flap is stretched with the first and second touch fastener components spaced apart, positioning the flap comprising bringing the stretched flap into contact with the outer surface of the pouch.

19. The method of claim 16, further comprising, with the flap positioned prior to releasing the flap, stretching the flap in a direction along the fastening plane and then releasing the flap with the first and second touch fastener components in contact, thereby increasing a residual shear load in the fastening plane.

* * * * *